United States Patent [19]

Coleman et al.

[11] 4,132,658

[45] Jan. 2, 1979

[54] PROCESS FOR MANUFACTURING ALUMINUM COMPLEX SOAP THICKENED GREASE

[75] Inventors: Richard L. Coleman, Port Arthur; Arnold C. Witte, Jr., Port Neches; Aubrey L. Stone, Beaumont, all of Tex.

[73] Assignee: Texaco Inc., New York, N.Y.

[21] Appl. No.: 890,750

[22] Filed: Mar. 27, 1978

[51] Int. Cl.[2] ..... C10M 1/20; C10M 3/14; C10M 5/12; C10M 7/16

[52] U.S. Cl. ..... 252/37.7

[58] Field of Search ..... 252/37.7

[56] References Cited

U.S. PATENT DOCUMENTS

| | | | |
|---|---|---|---|
| 3,345,291 | 10/1967 | Koundakjian et al. | 252/37.7 |
| 3,511,781 | 5/1970 | Hotten | 252/36 |
| 3,591,505 | 7/1971 | Polishuk | 252/37.7 |
| 3,620,975 | 11/1971 | Polishuk | 252/21 |
| 3,776,846 | 12/1973 | Bailey et al. | 252/37.7 |
| 3,791,972 | 2/1974 | Myers | 252/37.7 |
| 3,843,528 | 10/1974 | Bailey et al. | 252/18 |

*Primary Examiner*—Irving Vaughn

*Attorney, Agent, or Firm*—Carl G. Ries; Thomas H. Whaley; Douglas H. May, Jr.

[57] ABSTRACT

A process for manufacturing high dropping point aluminum complex soap thickened greases having selected consistency, water resistance, rheopectic properties, and antiwear properties.

6 Claims, No Drawings

PROCESS FOR MANUFACTURING ALUMINUM COMPLEX SOAP THICKENED GREASE

BACKGROUND OF THE INVENTION

1. Field of the Invention

The present invention relates to aluminum complex soap thickened greases. More particularly, the present invention relates to a process for manufacturing aluminum complex soap thickened greases of improved properties.

2. Description of the Prior Art

Aluminum complex soap thickened greases are known and used as industrial lubricants, particularly in the steel industry and other operations where high dropping point greases are required. That is, in services requiring dropping points in the range of 450–500° F and higher. Such aluminum complex soap thickened greases are described in the prior art, for example, in U.S. Pat. Nos. 3,843,528; 3,776,846; 3,620,975; 3,591,505; 3,511,781; 3,345,291; and in "The Development of Formulations for Aluminum Complex Thickener Systems", H. W. Kruschwitz, Proceeding 43rd NLGI Annual Meeting, St. Louis, Mo., October, 1975.

SUMMARY OF THE INVENTION

Now, according to the present invention, we have discovered improvements in the process for manufacturing aluminum complex soap thickened greases which contribute to manufacture of such greases having improved physical properties.

That is, in a process for manufacturing an aluminum complex soap thickened grease, which comprises blending selected organic acids, such as benzoic acid and stearic acid, with a petroleum derived base oil for producing an organic acid-base oil mixture; blending an aluminum compound suitable for use in making aluminum complex soap, such as trioxy-aluminum triisopropoxide, with said organic acid-base oil mixture for producing an organic acid-base oil-aluminum compound mixture; reacting, in a saponification reaction, said organic acid-base oil-aluminum compound mixture at an elevated temperature for forming an aluminum complex soap, e.g. aluminum benzoatestearate, dispersed within said base oil; blending extreme pressure additives into said aluminum complex soap-base oil mixture for producing an aluminum complex soap thickened grease product; and drawing said grease product into packaging; the process improvements which comprise:

a. mixing, in the organic acid-base oil blending step, about 50–60 percent of the base oil required in the grease product with the organic acids;

b. mixing, in said organic acid-base oil-aluminum compound blending step, a molar excess of aluminum compound over that stoichiometrically required for forming an aluminum complex soap;

c. heating, in said saponification step, said organic acid-base oil-aluminum compound mixture at 40–50° F per hour to a temperature of 365–375° F;

d. reacting, in said saponification step, said organic acid-base oil-aluminum compound mixture at 365–375° F for a period not exceeding one hour;

e. mixing 40–50 percent of the base oil required in the product grease with the aluminum complex soap-base oil mixture from the saponification step for increasing the rate of cooling the mixture to a temperature in the range of 150–170° F;

f. milling, in a colloid mill, a minor portion of the grease comprising aluminum complex soap, base oil and extreme pressure additives, and mixing said milled portion with the unmilled portion, at a temperature not exceeding 140° F, for increasing the consistency of the product; and g. drawing the product grease into packages at a temperature not exceeding 140° F.

By following the improvements of the present invention, aluminum complex soap thickened greases of improved physical properties are produced. That is, adding an excess of aluminum compound over that required for the aluminum complex soap results in grease products having improved lubricant properties. Milling only a portion of the grease in a colloid mill results in rheopectic properties such that the product grease hardens under shear conditions. Further, forming the aluminum complex soap (saponification) at a temperature in the range of 365–375° F within an hour or less results in a grease product of improved water resistance. Additionally, maintaining the grease at a temperature of 140° F or less during the drawing step results in a grease product of uniform appearance, free of gel-like inclusions. These advantages and others are more fully described in the detailed description which follows.

DETAILED DESCRIPTION OF THE INVENTION

In order to demonstrate the advantages of the present invention, the following example is provided. A commercial-sized batch of aluminum complex soap thickened grease, having good extreme pressure properties, good water resistant properties and excellent rheopectic properties was prepared in a grease manufacturing process employing the improvements of the present invention.

In this example, the grease was prepared in a commercial grease kettle equipped with heating means, cooling means, paddle type stirrer, gear-type circulation pump, circulation line, back pressure shear valve in said circulation line, colloid mill, product filter, and other associated piping, valves, instrumentation, etc. required for the commercial manufacture of grease.

According to the example, 508 pounds of triple pressed stearic acid, 218 pounds technical grade benzoic acid and 4350 pounds of base oil were charged to the grease kettle. The base oil was a blend of distillate fractions from paraffinic crude and residual fractions from naphthenic crude, having an open cup flash of 440° F, SUS viscosity at 100° F of 1100, SUS viscosity at 210° F of 82.5, and a pour point of 25° F.

In the kettle this mixture was heated with stirring to a temperature in the range of 130–140° F, at which the mixture was held with stirring for about 15 minutes for dissolving all the organic acids into the base oil.

Upon solution of the acids, circulation of the mixture, via the gear pump, was begun with the shear valve open such that no back pressure was maintained in the circulation line. The temperature was maintained in the range of 130–140° F. To this circulating mixture, 452 pounds of trioxy-aluminum triisopropoxide was added in the grease kettle in five equal increments (90.4 pounds) at five minute intervals such that the molar ratio of benzoic acid/stearic acid/aluminum was 1/1/1.2. The contents of the grease kettle were stirred and circulated at 130–140° F for an additional fifteen minutes to ensure thorough mixing.

According to the present invention, a molar excess of aluminum over that required stoichiometrically to form an aluminum benzotestearate complex soap is employed in the grease mixture such that the molar ratio of benzoic acid/stearic acid/aluminum is in the range of about 1/1/1 to about 1/1/2. The aluminum is added to the mixture in a form useful for forming such complex soap, that is, as a compound such as trioxy-aluminum triisopropoxide, aluminum isopropxide, or other compounds useful in grease manufacture.

The advantage of a molar excess of aluminum in this grease manufacturing process is; the lubricant properties of the grease are improved. For example, greases were manufactured according to this example, except the ratio of aluminum to benzoic acid and stearic acid was varied, and these greases were subjected to a wear test. Results of this wear test are shown in Table I below:

TABLE I

| GREASE SAMPLE | A | B | C |
|---|---|---|---|
| Mol. ratio benz/stear/Al | 1/1/1.2 | 1/1/1 | 1/1/0.8 |
| Al complex soap in grease (wt.%) | 6.3 | 7.1 | 6.3 |
| Worked penetration at 77° F | 330 | 324 | 312 |
| Scar Diameter(mm) | | | |
| 4 ball wear test, 1hr, 130° F, 1800 RPM, 20 kg | 0.40 | 0.50 | 0.58 |

Thus, it can be seen that grease (A), with an excess of aluminum in the complex soap resulted in decreased wear in the 4-ball wear test.

For forming the aluminum complex soap, the contents of the grease kettle were heated at a rate of 40–50° F/hr to a temperature in the rage of 365–375° F with stirring and circulation through the gear pump. In this saponification step, the shear valve was partially closed to provide 60 psig back pressure in the circulation line for imparting shear to the mixture. This shear improves contact of the trioxy-aluminum triisopropoxide with the organic acids, such that saponification is improved. Stirring and circulation of the grease kettle contents is continued at a temperature in the range of 365–375° F for a period not exceeding one hour. According to the present invention, we have discovered that the water resistant properties of the product grease may be substantially improved by limiting this saponification step at elevated temperatures to a period of one hour or less.

To demonstrate, grease prepared as in this example according to the present invention, having a saponification period of one hour at 365–375° F lost an average of 15.4 wt. percent in the ASTM D 1264 Water Washout Test at 175° F. On the other hand, grease prepared as in this example, except having a saponification period of three hours at 365–375° F, lost an average of 32.3 wt. percent in the ASTM D 1264 test at 175° F. Thus, the water resistance of grease prepared according to the present invention is substantially improved.

At the end of one hour saponification, the mixture was cooled at a rate of 40–50° F/hr., with stirring and circulation without back pressure through the shear valve. Upon reaching a mixture temperature of 200–210° F, 3847 pounds of base oil at about room temperature, as described above, were added at a rate of 60 lb/min and cooling was continued to a temperature of 150–170° F.

At a kettle mixture temperature of 150–170° F, an extreme pressure additive package was added to the kettle under conditions of stirring and circulation without back pressure. The extreme pressure additive comprised 200 lbs. sulfurized fatty oils, 400 pounds zinc dialkyl dithiophosphate, and 200 pounds of lead naphthenate. This additive package provided sufficient zinc, sulfur, phosphorous and lead compounds for the product grease to pass the ASTM D 2509 Timken Test at 40 pounds load. It is to be understood that other extreme pressure additive packages compatible with the grease may be used in accordance with the present invention.

Upon addition of the extreme pressure package, the kettle mixture was cooled to 140° F, and mixed under conditions of stirring and circulation with 60 psig back pressure through the shear valve for a period of 30 minutes for blending the extreme pressure materials with the kettle contents.

Upon blending the extreme pressure package into the kettle contents, the grease was tested for worked penetration (ASTM D-217). The desired worked penetration was in the range of 320–330 at 77° F. As the grease was too soft, a small portion of the grease was milled in a colloid mill having 0.006 inch clearance. The milled grease was mixed with the kettle contents and the ASTM D-217 penetration test was repeated. Milling of small portions of the grease was continued until the worked penetration was 330.

By milling only small portions of the grease (from 2–10 percent) in the colloid mill, and blending the milled and unmilled grease, the consistency of the grease is increased, in one or more milling steps, to the desired worked penetration value range. Also, it was discovered that since the major portion of the grease remains unmilled, the rheopectic properties of the product grease were such that the grease consistency increased under shear. For example, the rheopectic properties of grease (A) of Table I, are shown in Table II, below:

TABLE II

| GREASE A | |
|---|---|
| Worked penetration at 77° F | 331 |
| Penetration, worked 10,000 strokes | 309 |
| Percent Change | −6.4 |
| Penetration, worked 100,000 strokes | 296 |
| Percent Change | −10 |

As can be seen, the penetration decreases (consistency increases) as the grease is worked under shear conditions. This is a particularly useful property for greases in high temperature services, such as in hot steel rolling mills. The increase in grease consistency as a result of shear tends to off-set the decrease in consistency from increased temperature.

The grease, at the desired worked penetration was drawn from the kettle at a temperature less than 140° F, passed through a 0.005 inch Purolator filter, into drums, as product grease.

According to the present invention, the grease, after adding the extreme pressure package, and during the milling step and drawing step was maintained at a temperature of 140° F or less. We have discovered that at temperatures above 140° F, soft gelatinous inclusions form in the grease, whereas at temperatures less than 140° F such inclusions do not form, and the grease is of uniform consistency.

Base oils useful in the present invention are those useful in manufacturing aluminum complex soap thickened greases. Such base-oils are distillate and/or residual fractions of petroleum oils which contribute to the desired properties of the particular grease being manufactured. The base oils affect the lubricity, dropping point, and oxidation resistance of the grease product, and are selected for their contribution to a grease product in the particular service for which the grease is intended.

Organic acids useful in the present invention are those useful in production of an aluminum complex soap which will contribute the desired thickening, lubricating, and water resistance properties to the product grease. Such acids generally comprise a mixture of two significantly different monocarboxylic acids which in combination produce an aluminum complex soap significantly different from soaps produced from either acid alone. For example, mixtures of benzoic acid (an aromatic carboxylic acid) and stearic acid (a straight chain fatty acid) produce an aluminum complex soap which serves in the manufacture of a grease having high melting point. Mixtures of carboxylic acids having carbon numbers in the range of about $C_1$–$C_{20}$, which serve to produce aluminum complex soaps having the desired properties may be used in the process of the present invention. Particularly preferred for manufacturing the high dropping point greases disclosed herein is an equimolar mixture of benzoic and stearic acids. In the greases of the present invention, it has been found that the aluminum complex soap must be present in an amount of at least 7.5 weight percent of the product grease in order to obtain consistently satisfactory water resistance. Therefore, sufficient organic acids and aluminum must be employed to obtain at least 7.5 weight percent aluminum complex soap in the grease product. Aluminum complex soap serves to increase the grease consistency, and increased soap increases the consistency. Therefore, to obtain an NLGI No. 1 grade product, the organic acids should not exceed an amount which will produce a grease containing about 12 weight percent soap.

In the grease manufacturing process of the present invention, the organic acids are reacted with aluminum, in the form of an organo-aluminum compound, in the presence of base oil to produce an aluminum complex soap dispersed in the base oil. Organo-aluminum compounds reactive with organic acids for producing aluminum complex soaps may be used in the present invention. For example, aluminum isopropoxides may be used. Preferably, the organo-aluminum compound is trioxy-aluminum triisopropoxide.

According to the present invention, we have discovered that an excess of organo-aluminum over that required to form the Aluminum Complex Soap contributes to an unexpected improvement in antiwear properties of the product grease. That is, sufficient organo-aluminum compound to provide from about ½ to one aluminum ion for each carboxylic acid group present in the organic acids substantially improves the anti-wear properties as exemplified in the 4-ball wear test. For example, in the case where benzoic acid and the stearic acid are employed in a molar ratio of 1/1, sufficient trioxy aluminum triisopropoxide is added to produce a benzoic acid/stearic acid/aluminum molar ratio in the range of 1/1 to 1/1/2. Preferably, the benzoic acid/stearic acid/aluminum ratio is about 1/1/1.2.

Extreme pressure additives are employed in grease compositions for improving lubricating properties under heavy load conditions. Extreme pressure additives generally comprise a group of chemical compounds, each member of which contributes to improved lubricating properties under extreme pressure conditions. A group of such compounds is referred to as an "Extreme Pressure Additive Package".

A large number of extreme pressure additive packages are available for use in grease compositions. In the present example, an extreme pressure additive package was used which provided sufficient zinc, sulfur, phosphorus and lead compounds to enable the product grease to pass the ASTM D 2509 Timken Test at 40 pound load.

In the process of the present invention, organic acids are blended with a base oil at a temperature sufficient to allow the acids to dissolve. Preferably, this temperature does not exceed about 185° F, and the amount of base oil is limited to about 50–60 percent of the amount of oil present in the product grease. The remainder of the oil is reserved for use in cooling the mixture after saponification, as described below.

Upon solution of the organic acids in base oil, a molar excess of an organo-aluminum compound is added and blended, and the mixture is heated to saponification temperature. Preferably the heating rate is about 40–50° F/hr. and the saponification temperature is in the range of 365–375° F. During saponification, the mixture is subjected to high shear mixing to improve mass transfer and thereby increase the saponification reaction rate. We have discovered that the time period which the grease mixture is maintained at the elevated saponification temperature has a substantial effect upon the water resistance of the product grease. The reaction mixture should spend no more than one hour at the elevated saponification temperature, and then be cooled rapidly to a temperature below 185° F.

In the process of the present invention, the remaining 40–50 percent of base oil, at about ambient temperature, is added to the reaction mixture after saponification, for increasing the cooling rate.

Upon cooling the saponified mixture, the extreme pressure additive compounds are blended, and the grease mixture is cooled to a temperature no greater than 140° F.

According to the present invention, we have discovered that maintaining the grease at a temperature below about 140° F in subsequent drawing operations results in a grease product of uniform appearance. If the grease temperature is allowed to exceed 140° F by a substantial amount, gelatinous inclusions form within the body of grease upon cooling.

Aluminum complex soap thicked greases manufactured according to the process of the present invention possess excellent rheopectic properties. That is, the greases tend to harden during shearing action. This property makes the products particularly suitable for applications wherein other greases tend to soften and leak from the point of application. Since these aluminum complex soap thickened greases harden under shear, they can be manufactured to a relatively soft consistency so pumpability and handling properties are good, and the greases will become hard enough in shearing applications such that leakage from the point of application will not occur.

For production of greases having such rheopectic properties, an improved milling procedure is one element of the improved process of the present invention. According to the present invention, a minor amount of the grease, after addition of extreme pressure additives, is milled in a colloid mill, and the milled grease is thoroughly mixed with the unmilled grease to produce a product grease having the desired consistency. Milling in a colloid mill is a high shear operation which greatly increases consistency of the milled grease. Reblending the milled grease with unmilled grease produces a product of intermediate consistency which possesses the property of increasing in consistency when subjected to additional shearing forces. As milling in a colloid mill inparts thermal energy to the grease, the temperature of the milled grease rises. Reblending milled grease with unmilled grease minimizes temperature increase of the total product. Thus, milling only a small portion of the grease and blending with the unmilled grease makes possible maintenance of grease product temperatures not exceeding 140° F in the drawing step.

After milling and reblending to obtain a desired consistency, the product grease is drawn into packages. The drawing operation is carried out at temperatures not exceeding about 140° F for preventing formation of gelatinous inclusions in the cooled product grease.

Thus, we have discovered process improvements for manufacturing aluminum complex soap thickened greases of improved water resistance, improved antiwear properties, excellent rheopectic properties and uniform appearance.

While we have shown and described a preferred embodiment of our invention, we are aware that modifications and variations thereto will occur to those skilled in the art. Therefore, we desire a broad interpretation of the invention within the scope and spirit of the specification herein and the claims appended.

We claim:

1. In a process for manufacturing aluminum complex soap thickened greases, comprising blending, in a first blending step, a base oil with organic carboxylic acids, suitable as precursors of aluminum complex soap to form a base oil-organic acid mixture, blending, in a second blending step, said base oil-organic acids mixture with an organo-aluminum compounds suitable as a precursor of aluminum complex soap to form a base oil-organic acid-organo-aluminum mixture, reacting, a saponification step, said base oil-organic acid-organo aluminum mixture, at elevated temperature under conditions of high shear mixing to produce a base oil-aluminum complex soap mixture, blending, in a third blending step, said base oil-aluminum complex soap mixture with extreme pressure additives for producing a grease mixture, milling, in a colloid milling step, said grease mixture for increasing the consistency of said grease mixture to a predetermined value, and drawing said hardened grease mixture, as aluminum complex soap thickened grease product into packages or storage; the improvements which comprise:

a. providing, in said second blending step, a molar excess of said organo aluminum over that required for forming aluminum complex soap with said organic carboxyllic acids such that the ratio of carboxylic acid functions to aluminum is in the range of 1/0.5 to 1/1 respectively for improving antiwear properties of said aluminum complex soap thickened grease product;

b. reacting, in said saponification step, said base oil-organic acid-organo aluminum mixture at a temperature in the range of about 365–375° F for a period not exceeding about one hour, for improving water resistance of said aluminum complex soap thickened grease product;

c. milling, in said colloid milling step, a minor portion of said grease mixture for increasing the consistency of said milled portion;

d. blending, in a fourth blending step, said milled minor portion of said grease mixture with the unmilled major portion of said grease mixture at a temperature of about 140° F or less for producing said aluminum complex soap thickened grease product of desired consistency and having rheopectic properties such that the consistency of the grease product increases under shear conditions; and e. drawing, in said drawing step, said aluminum complex soap thickened grease product at a temperature of about 140° F or less into packages or storage such that said aluminum complex soap thickened grease is of uniform appearance and essentially free of gelatinous inclusions.

2. The process of claim 1 wherein sufficient organic carboxylic acids are employed to provide at least about 7.5 weight percent aluminum complex soap in said Aluminum Complex Soap thickened grease product, for improving water resistance thereof.

3. The process of claim 2 wherein said organic carboxylic acids are selected from $C_1$–$C_{20}$ range monocarboxylic acids.

4. The process of claim 3 wherein said organic carboxylic acids comprise benzoic acid and stearic acid in about equimolar ratio, and wherein said organo aluminum compound is trioxy-aluminum triisopropoxide in an amount sufficient to provide from about ½ to 1 moles of aluminum per mole of organic acid.

5. The process of claim 4 wherein the ratio of benzoic acid/stearic acid/aluminum is about 1/1/1.2.

6. The process of claim 5 wherein about 40–50 percent of said base oil required for manufacture of said aluminum complex soap thickened grease is blended with said organic carboxylic acid in said first blending step, and wherein the remaining 50–60 percent of said base oil is added immediately after said saponification step for increasing the rate of cooling.

* * * * *